US006874491B2

(12) United States Patent
Bednar

(10) Patent No.: US 6,874,491 B2
(45) Date of Patent: Apr. 5, 2005

(54) CROSSBOW ROPE COCKING DEVICE

(76) Inventor: William Bednar, 1325 Waterloo Rd., Suffield, OH (US) 44260

( * ) Notice: Subject to any disclaimer, the term of this patent is extended or adjusted under 35 U.S.C. 154(b) by 0 days.

(21) Appl. No.: 10/760,041

(22) Filed: Jan. 15, 2004

(65) Prior Publication Data

US 2005/0022799 A1 Feb. 3, 2005

Related U.S. Application Data

(60) Provisional application No. 60/440,402, filed on Jan. 15, 2003.

(51) Int. Cl.[7] ..... F41B 5/12
(52) U.S. Cl. ..... 124/25
(58) Field of Search ..... 124/25

(56) References Cited

U.S. PATENT DOCUMENTS

| | | | | | |
|---|---|---|---|---|---|
| 4,662,345 | A | * | 5/1987 | Stephens | 124/25 |
| 4,942,861 | A | * | 7/1990 | Bozek | 124/25 |
| 5,243,956 | A | * | 9/1993 | Luehring | 124/86 |
| 6,286,496 | B1 | * | 9/2001 | Bednar | 124/25 |

* cited by examiner

*Primary Examiner*—John A. Ricci
(74) *Attorney, Agent, or Firm*—Brouse McDowell; Roger D. Emerson; John M. Skeriotis

(57) ABSTRACT

A device to provide assistance in drawing back the bowstring of a crossbow. In particular, a device that assists an operator which drawing back the bowstring of a crossbow to allow the crossbow to be loaded with a projectile and fired in an appropriate manner.

11 Claims, 7 Drawing Sheets

CROSSBOW ROPE COCKING DEVICE

This application claims the benefit of U.S. Provisional Application No. 60/440,402, filed Jan. 15, 2003.

I. BACKGROUND OF THE INVENTION

A. Field of Invention

This invention pertains to the art of methods and apparatuses for drawing back the bowstring of a crossbow.

B. Description of the Related Art

It is known in the art to draw back the bowstring for a crossbow device. Since crossbows propel the bolts therefrom with the force of the bowstring, a substantial force is needed to accurately target the intended game. As a result, it may be difficult for the operator to overcome the bowstring force, especially if the operator is smaller in stature or has physical limitations.

It is also known in the art to provide elaborate mechanisms for drawing back the bowstring of the crossbow device. These mechanisms can add unwanted weight and bulk during use. Additionally, such mechanisms can be expensive. What is needed is a simple and inexpensive device to ease the drawing back of the bowstring of a crossbow.

II. SUMMARY OF THE INVENTION

It is an object of the present invention to disclose a rope-cocking device that is simple to operate.

It is another object of the present invention to disclose a rope-cocking device that helps to ease the drawing back of the bowstring of a crossbow.

It is another object of the present invention to disclose a crossbow cocking device. The cocking device has a shaft member with first and second sides. The shaft member is operatively rotatably connected with respect to an associated butt of the associated cross bow. The cocking device also has first rope member with first and second ends. The first end of the first rope member is fixedly connected to the first side of the shaft member. The cocking device also has a first hook member for use in receiving an associated crossbow string. The first hook member is operatively connected to the second end of the first rope member. The cocking device may also have a first handle portion for use in manually drawing back the associated crossbow string. The first handle portion is operatively connected to the first hook member.

It is another object of the present invention to disclose a crossbow cocking device so that when the first handle portion is manually drawing back the crossbow string, the first rope member is automatically wound around the first side of the shaft member.

It is still another object of the present invention to disclose a crossbow cocking device. The cocking device may have first and second rope members. Both the first and second rope members have first and second ends. The first end of the first rope member is fixedly connected to a first side of a shaft member. The first end of the second rope member is fixedly connected to a second side of the shaft member. The cocking device may have first and second hook members for use in receiving an associated crossbow string. The first and second hook members are operatively connected to the second end of the first and second rope members, respectively.

It is yet another object of the present invention to disclose a crossbow cocking device that may further have first and second handle portions for use in manually drawing back the associated crossbow string. The first and second handle portions are operatively connected to the first and second hook members, respectively. When the first and second handle portions are manually drawing back the crossbow string the first and second rope members are automatically wound around the shaft member.

It is another object of the present invention to disclose a crossbow cocking device that may further have a first side plate operatively connected to a first side of a shaft member; and a second side plate operatively connected to a second side of a shaft member.

It is yet another object of the present invention to disclose a crossbow cocking device that may have a biasing means operatively connected to a shaft member. The biasing means is for use in biasing the shaft member in a first rotatable direction.

It is sill another object of the present invention to disclose a crossbow cocking device having a biasing means, which may be a spring. When the first and second handle portions are manually drawing back the crossbow string, the spring automatically retracts the first and second rope members.

It is another object of the present invention to disclose a method of drawing back a crossbow string for an associated crossbow. The associated crossbow having a stock including first and second ends, a butt portion, a crossbow string and a trigger mechanism. The method of drawing back the crossbow string comprises the step of providing a crossbow cocking device. The cocking device has a shaft member operatively connected to the associated crossbow, and first and second rope members are operatively connected to the shaft member. The cocking device also has first and second hook members operatively connected to the first and second rope members respectively. The method further comprises the step of placing the first and second hook members onto the crossbow string. Then, manually drawing back the crossbow spring; and, automatically rewinding the first and second rope members around the shaft member.

It is yet another object of the present invention to disclose a method of providing a crossbow cocking device. The method includes the steps of providing a crossbow cocking device. The crossbow cocking device has a shaft member with first and second sides. The shaft member is operatively rotatably connected with respect to an associated butt of the associated crossbow. The cocking device also has first and second rope members with first and second ends. The first end of the first rope member is connected to the first side of the shaft member. The first end of the second rope member is connected to the second side of the shaft member. The cocking device also has first and second hook members connected to the second ends of the first and second rope members respectively. The method further includes the steps of manually drawing back the crossbow spring and receiving the associated bowstring by the associated trigger mechanism. Then, the steps of disengaging the first and second hook members from the crossbow spring and automatically retracting the first and second hook members into proximity of the associated butt.

The subject invention relates to crossbow that uses a cocking device to draw back the bowstring of the crossbow. The cocking device includes a shaft member, a first rope member, a first hook member and a first handle portion. The cocking device may further include a second rope member and a second hook member as well as a second handle portion. In addition, the cocking device may have a first and second side plate connected to the shaft member. There may also be a biasing means operatively connected to the shaft member for use in biasing the shaft member in a first rotatable direction. When the handle portion is manually drawing back the crossbow string, the biasing means automatically retracts the rope member.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
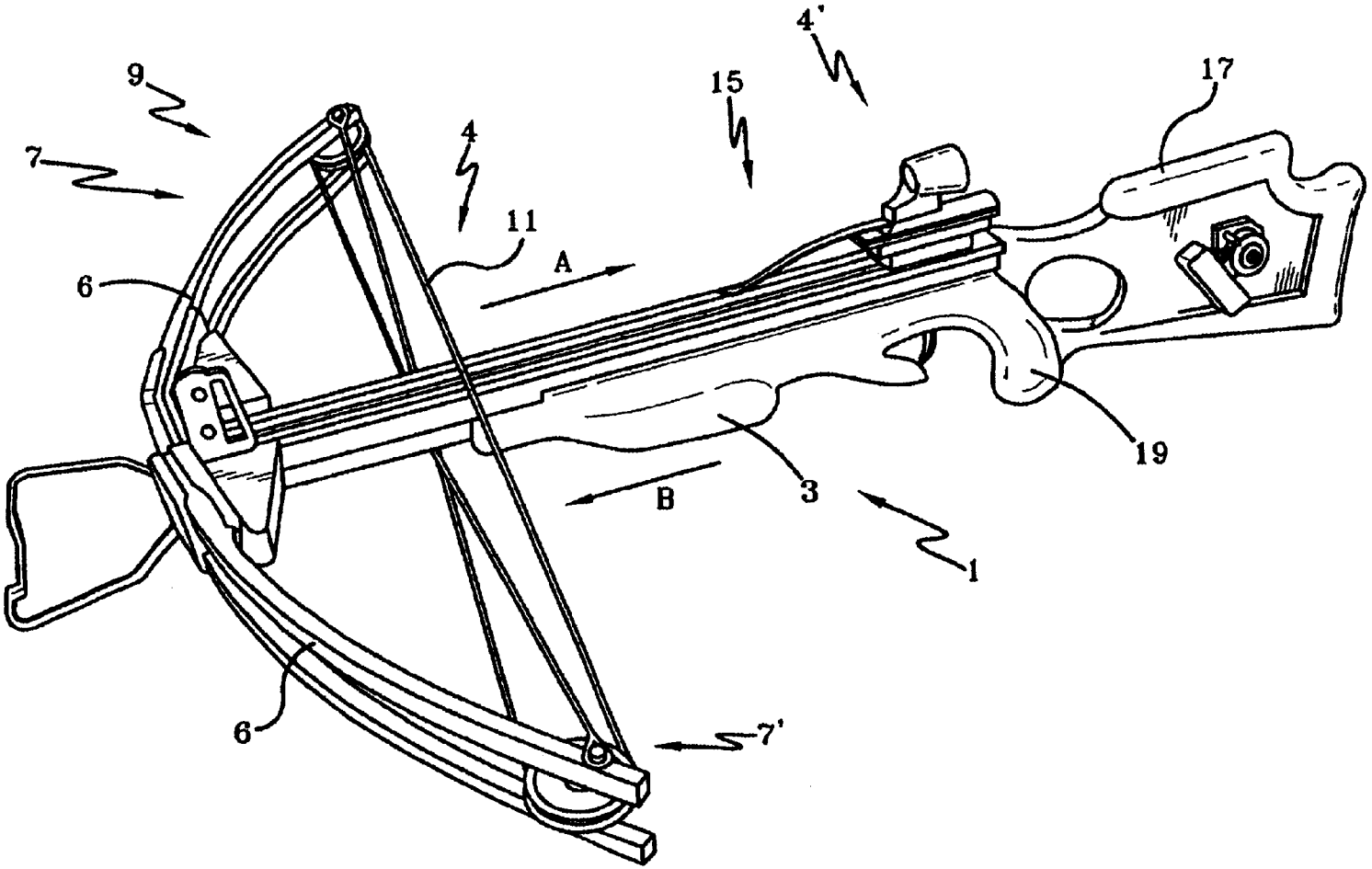
FIG. 1 is a perspective view of a crossbow.
Figure 2:
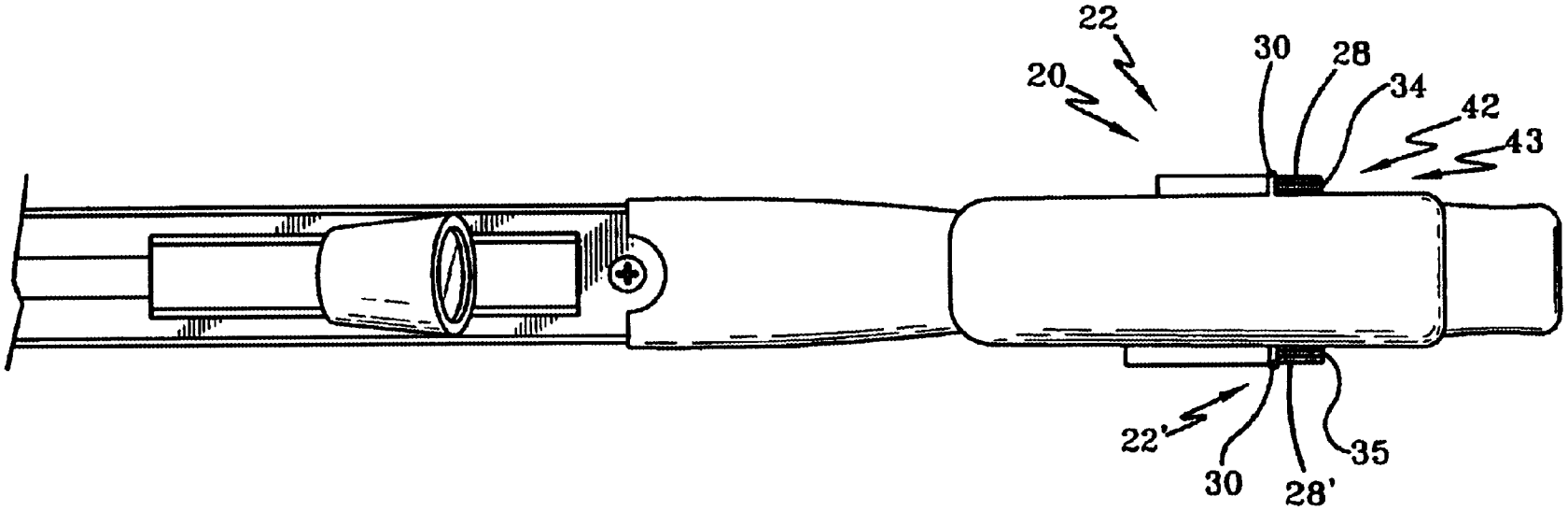
FIG. 2 is a perspective view of a top view of the butt of the crossbow.
Figure 3:
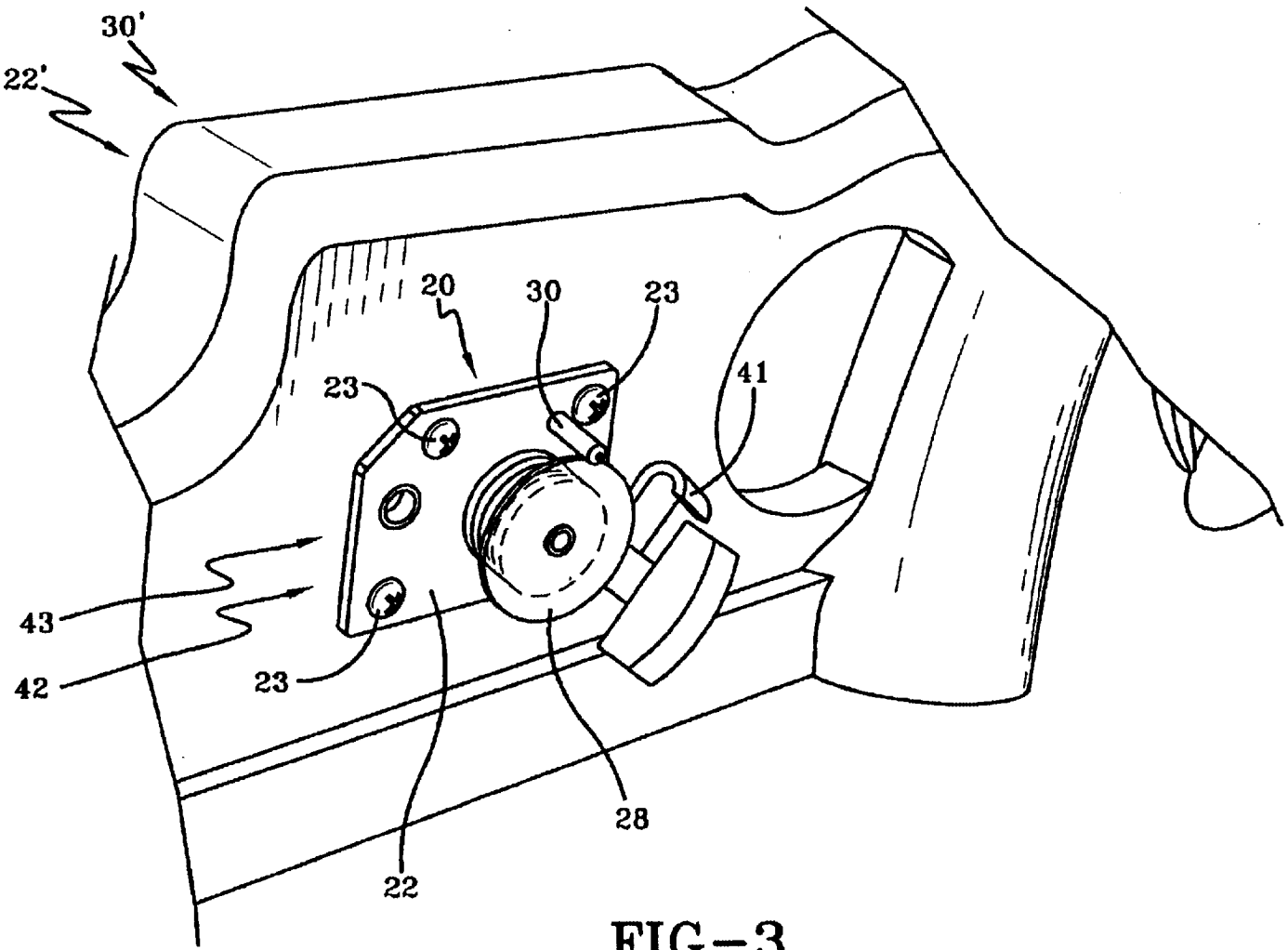
FIG. 3 is a perspective side view of the butt of the crossbow.
Figure 4:
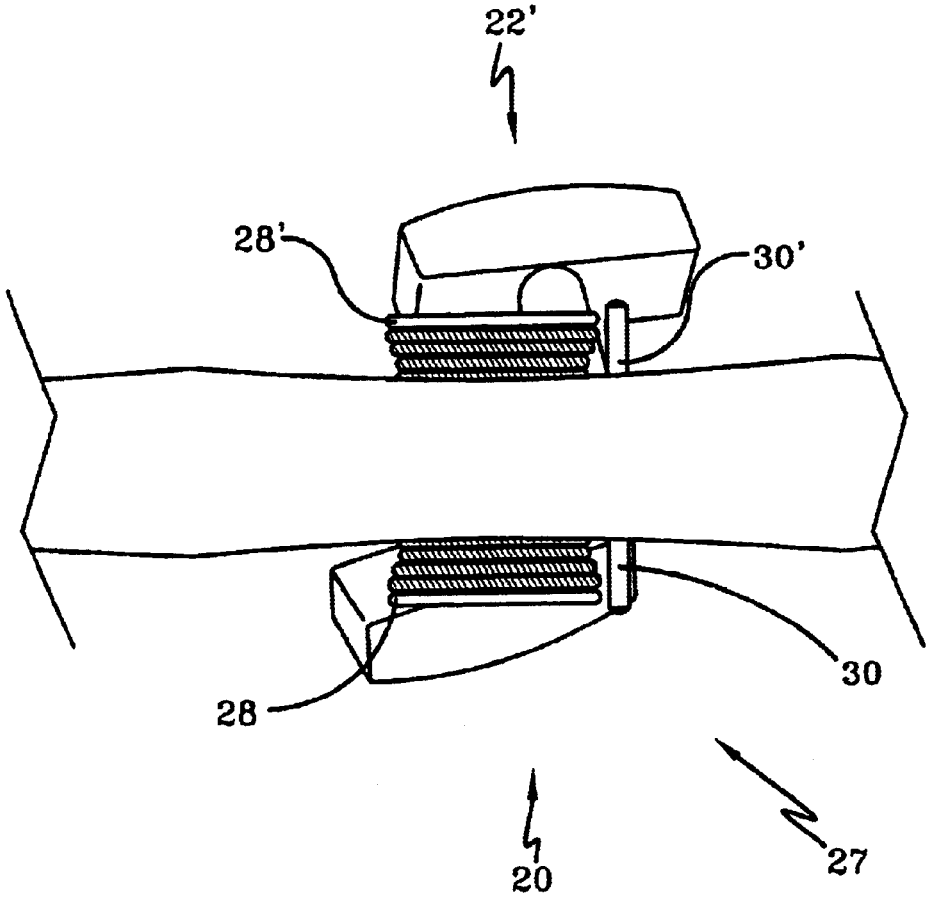
FIG. 4 is a perspective end view of the butt of the crossbow.
Figure 5:
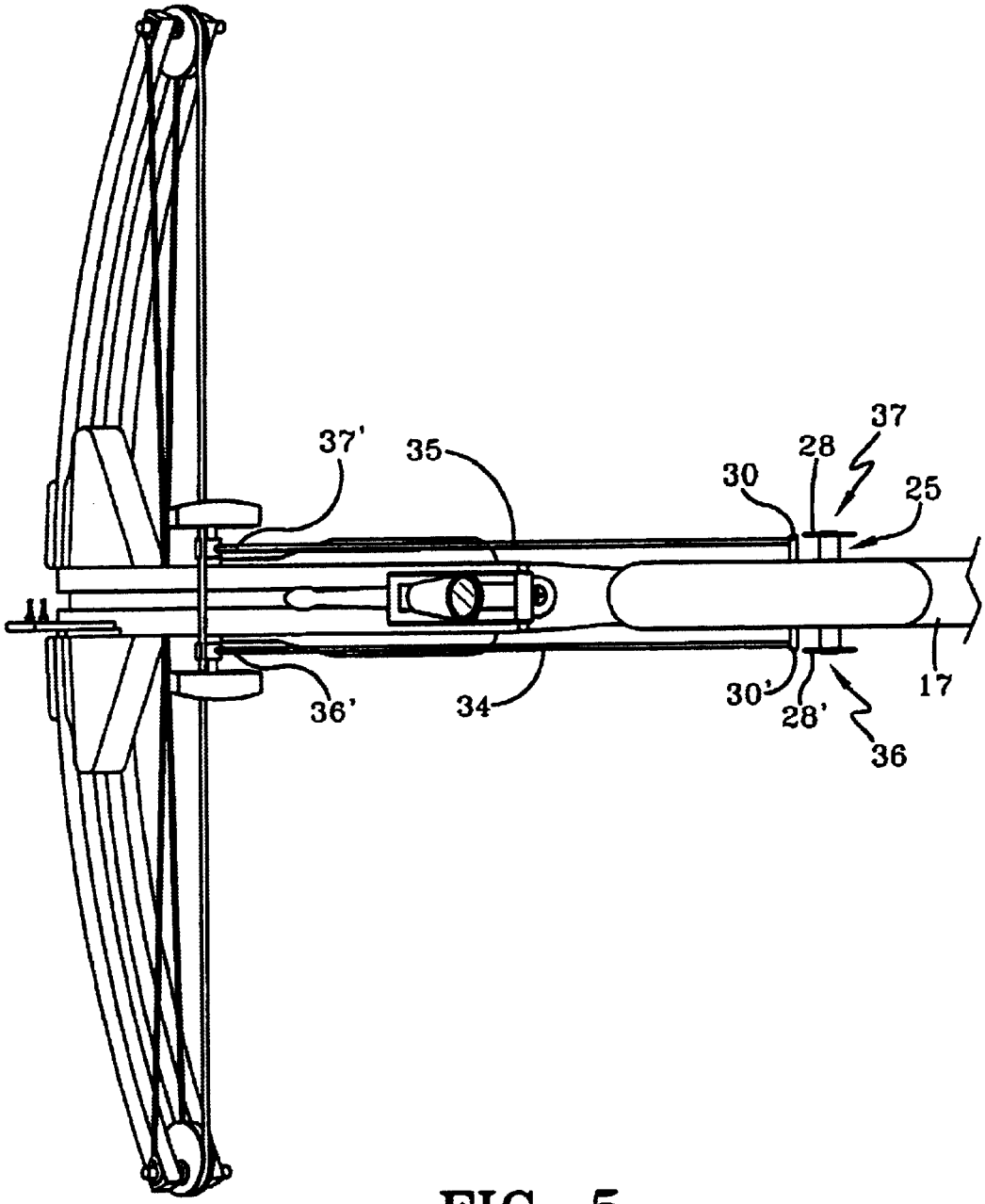
FIG. 5 is a perspective view of a crossbow.
Figure 6:
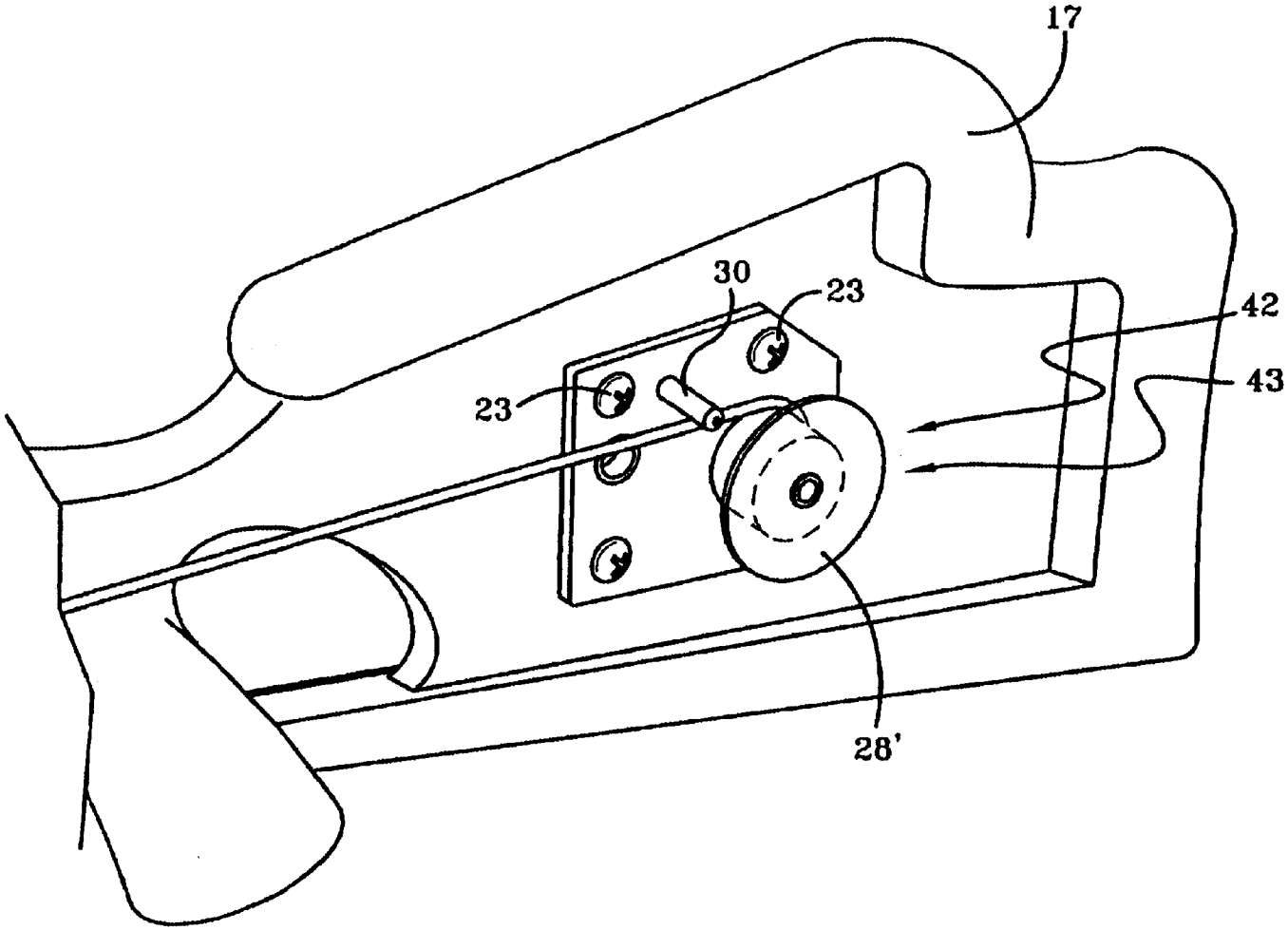
FIG. 6 is a perspective side view of the butt of the crossbow.

Referring now to the drawings wherein the showings are for purposes of illustrating a preferred embodiment of the invention only and not for purposes of limiting the same, FIG. 1 shows a crossbow depicted generally at 1. The crossbow 1 may include a crossbow stock 3. The stock 3 may be generally longitudinal having first and second ends 4, 4' respectively. A crossbar 6 may be juxtaposed to the first end 4 of the stock 3 and fixedly connected thereto in a manner well known in the art. The crossbar 6 may include first and second ends 7, 7' that define an axis 9 that extends generally perpendicular to the longitudinal axis of the stock 3. The ends 7, 7' of the crossbar 6 may receive a bowstring 11 that extends between the ends 7, 7' of the crossbar 6 in a manner well known in the art. The crossbow 1 may be configured such that when the bowstring 11 is drawn back in a first direction A, the crossbar 6 may flex or bend storing potential energy in the device 1. The bowstring 11 may be secured in place by a trigger mechanism 15 that selectively holds the bowstring 11 until it is desired to release or discharge the crossbow 1. An associated operator may place a projectile or bolt, not shown, onto the top portion of the stock 3 and fit a first end of the bolt over the bowstring 11. After such time, the trigger mechanism 15 may be engaged; releasing the force stored in the device 1 and propelling the projectile forward in a direction B.

With continuing reference to FIG. 1, the crossbow 1 may include a crossbow butt 17. The butt 17 may be juxtaposed to the associated operator's shoulder during discharge of the device 1. A grip 19 may be fashioned in the stock 3 wherein the trigger mechanism 15 is installed proximate to the grip 19; toward the second end 4' of the stock 3. This allows the associated operator to securely grasp the crossbow I with a first hand during operation of the device 1. The other hand of the associated operator may grasp the stock 3 toward the first end 4 thereof. This allows the operator to firmly hold the crossbow 1 during operation and discharge.

With reference now to FIGS. 2 through 6, a crossbow rope-cocking device is shown generally at 20. The cocking device 20 may include first and second base plates 22, 22'. The base plates 22, 22' may be positioned adjacent, one to each side of, the butt 17. Fasteners 23 may be used to securely affix the base plates 22, 22' to the butt 17 of the crossbow 1. It is noted that any manner of affixing the base plates 22, 22' to the butt 17 may be chosen with sound engineering judgment. It is also contemplated in an alternate embodiment that the base plates 22, 22' may be integrally formed with the butt 17. A shaft member 25, shown in FIG. 5, may be rotatably received through the base plates 22, 22' in any manner chosen with sound engineering judgment. In this manner, the shaft member 25 may be positioned substantially perpendicular to the longitudinal axis of the crossbow and rotated thereabout as will be discussed in a subsequent paragraph. Side plates 28, 28' may be juxtaposed and affixed, one to each end of, the shaft member 25. The side plates 28, 28' may be fixedly connected with respect to the shaft member 25, rotating therewith during operation. The side plates 28, 28' may also be of any shape and configuration chosen with sound judgment as is appropriate for retaining rope members, to be discussed in a subsequent paragraph. Limiting pins 30, 30' are also shown extending from the base plates 22, 22'. The pins 30, 30' may be fashioned integrally with base plates 22, 22'. However, in the preferred embodiment, the pins 30, 30' are separately constructed pins that may be fastened to the plates 22, 22' and/or the butt 17 in any manner chosen with sound engineering judgment. The pins 30, 30' may be positioned to restrict movement of the rope members during retraction and extension from the shaft member 25, which will be discussed in detail in a subsequent paragraph.

Figure 7:
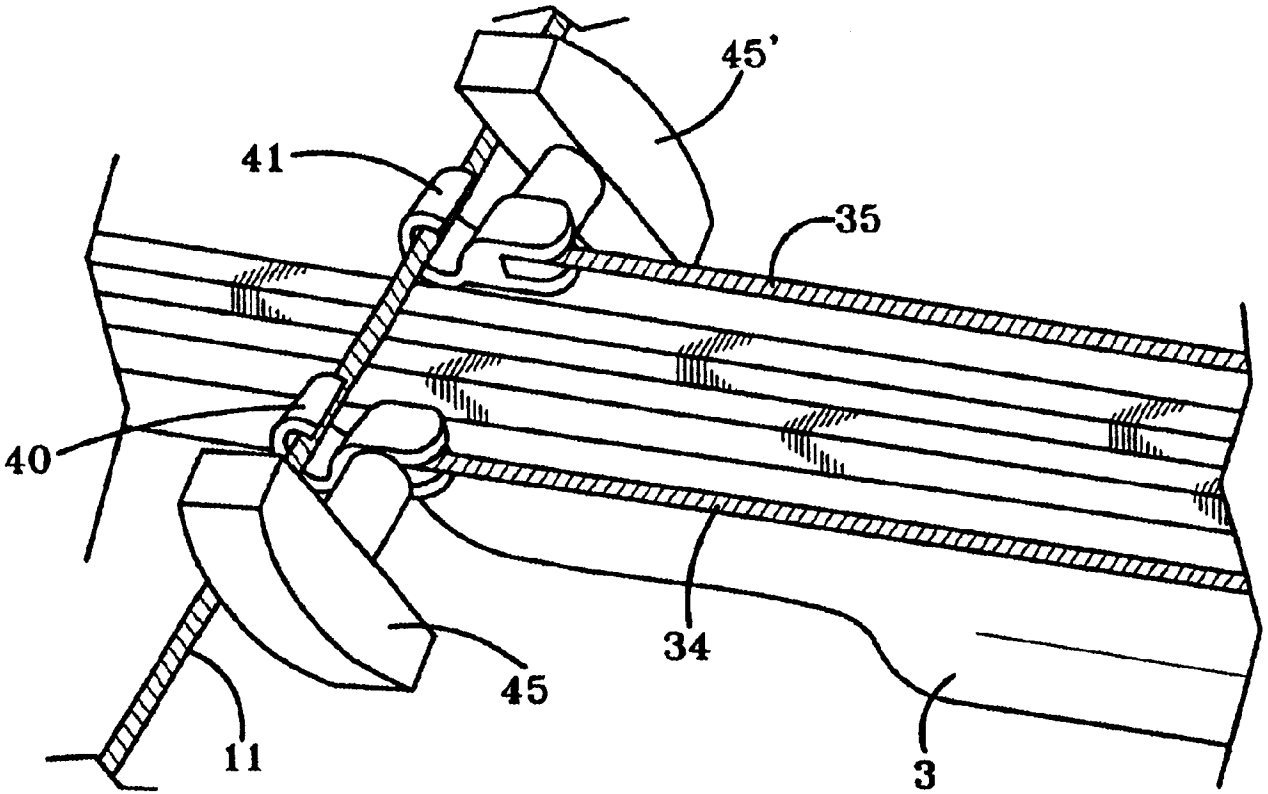
FIG. 7 is a perspective view of the cocking device of the crossbow.

With continued reference to FIGS. 2 through 6 and now to FIG. 7, first and second rope members 34, 35 are shown connected to the cocking device 20. The rope members 34, 35 may have first 36, 37 and second 36', 37' ends respectively (shown in FIG. 5). The first ends 36, 37 of the rope members 34, 35 may be fixedly attached to the shaft member 25. The side plates 28, 28' may be fashioned to include rope-receiving portions that receive the rope members 34, 35 respectively. In this manner, when the cocking device 20 is engaged, that is to say that when the side plates 28, 28' and shaft member 25 are rotated to retract the rope members 34, 35, the rope members 34, 35 may be wound about the circumference of the shaft member 25 to take up slack during cocking of the cross bow. The pins 30, 30' may function to prevent up and down movement of the rope members 34, 35 with respect to the stock of the crossbow. A biasing means 42, which may be a spring 43, may be connected to bias the shaft member 25 to retract the rope members 34, 35. However, any means of biasing for use in retracting the rope members 34, 35 may be chosen with sound engineering judgment. In this manner, when the rope members 34, 35 are not being used to retract the bowstring 11, the shaft member 25 automatically retracts or takes up slack in the rope members 34, 35 during operation thereof. In this manner, the shaft member 25 rotates in a first retracting direction as biased by the biasing means 42. With reference to FIG. 7, the second ends 36', 37' of the rope members 34, 35 may be affixed to hook members 40, 41 respectively. The hook members 40, 41 may reside one on each side of the stock 3 of the crossbow 1. The hook members 40, 41 may be fashioned to engage the bowstring 11. In this manner, when the hook members 40, 41 are placed onto the bowstring 11 and retracted, the bowstring 11 will be drawn back until it is received by the trigger mechanism 15. It is noted that the hook members 40, 41 may also be placed under the bowstring 11, hooked thereon and retracted in a similar manner. At this point, the hook members 40, 41 may be disengaged from the bowstring 11, allowing the crossbow to be loaded with a projectile and fired in an appropriate manner. It should be noted that when the hook members 40, 41 are being drawn back, the rope members 34, 35 may be automatically retracted and wound about the shaft member 25 as previously discussed.

With continued reference to all of the Figures, the hook members 40, 41 may include handle portions 45, 45' integrally fashioned therewith. The handle portions 45, 45' may be fashioned for use in securely gripping the hook members 40, 41. In this manner, an associated operator may grasp the handle portions 45, 45' of the hook members 40, 41 and apply a force in the direction A, overcoming the force of the bowstring 11 thereby retracting the bowstring 11 into a cocked position. Subsequently, the hook members 40, 41 may be removed from the bowstring 11 leaving the crossbow 1 cocked for discharging in an appropriate manner.

With reference to all of the FIGURES, the operation of the subject invention will now be discussed. An operator would place the hook members 40, 41 of the cocking device 20 onto the bowstring 11 of the crossbow 1. Subsequently, with both first and second hook members 40, 41 connected thereto, the operator would manually draw back the bowstring 11 until the bowstring 11 is received by the trigger mechanism 15. As the operator is manually drawing back the bowstring 11, the biased shaft member 25, onto which the first and second rope members 34, 35 are connected, will automatically rotate in a first retracting direction to automatically rewind the first and second rope members 34, 35 around the shaft member 25. Once the bowstring 11 is cocked, the operator may disengage the hook members 40, 41 after which the operator would load a projectile onto the crossbow.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. A crossbow cocking device, comprising:

a shaft member operatively rotatably connected with respect to the associated butt of the associated cross bow, the shaft member having first and second sides;

at least a first rope member having first and second ends, the first end of the at least a first rope member being fixedly connected to the first side of the shaft member;

at least a first hook member for use in receiving an associated crossbow string, wherein the at least a first hook member is operatively connected to the second end of the at least a first rope member; and, at least a first handle portion for use in manually drawing back the associated crossbow string, the at least a first handle portion being operatively connected to the at least a first hook member.

2. The crossbow cocking device as in claim 1, wherein when the at least a first handle portion is manually drawing back the crossbow string, the at least a first rope member is automatically wound around the first side of the shaft member.

3. The crossbow cocking device as in claim 2, further comprising:

a second rope member having first and second ends, the first end of the second rope member being fixedly connected to the second side of the shaft member; and, a second hook member for use in receiving the associated crossbow string, wherein the second hook member is operatively connected to the second end of the second rope member.

4. The crossbow cocking device as in claim 3, further comprising:

a second handle portion for use in manually drawing back the associated crossbow string, the second handle portion being operatively connected to the second hook member wherein when the second handle portion is manually drawing back the crossbow string the second rope member is automatically wound around the second side of the shaft member.

5. The crossbow cocking device as in claim 4, further comprising:

first side plate operatively connected to the first side of the shaft member; and second side plate operatively connected to the second side of the shaft member.

6. The crossbow cocking device as in claim 5, further comprising:

biasing means operatively connected to the shaft member for use in biasing the shaft member in a first rotatable direction.

7. The crossbow cocking device as in claim 6, wherein the biasing means is a spring; and, wherein when the first and second handle portions are manually drawing back the crossbow string, the spring automatically retracts the first and second rope members.

8. A method of drawing back a crossbow string for an associated crossbow having a stock including first and second ends, a butt portion, a crossbow string and a trigger mechanism, the steps comprising:

providing a crossbow cocking device having:

a shaft member operatively connected to the associated crossbow;

first and second rope members operatively connected to the shaft member;

first and second hook members operatively connected to the first and second rope members respectively;

placing the first and second hook members onto the crossbow string;

manually drawing back the crossbow spring; and, automatically rewinding the first and second rope members around the shaft member.

9. The method of claim 8, wherein the step of providing a crossbow cocking device, comprises the step of:

providing a crossbow cocking device having:

a shaft member having first and second sides operatively rotatably connected with respect to the associated butt of the associated crossbow;

first and second rope members having first and second ends, wherein the first end of the first rope member is connected to the first side of the shaft member, wherein the first end of the second rope member is connected to the second side of the shaft member; and, first and second hook members being connected to the second ends of the first and second rope members respectively.

10. The method of claim 9, wherein after the step of manually drawing back the crossbow spring, the steps further comprising:

receiving the associated bowstring by the associated trigger mechanism; and, disengaging the first and second hook members from the crossbow spring.

11. The method of claim 10, further comprising the step of:

automatically retracting the first and second hook members into proximity of the associated butt.

* * * * *